US007929896B2

(12) United States Patent
Matayoshi et al.

(10) Patent No.: US 7,929,896 B2
(45) Date of Patent: Apr. 19, 2011

(54) IMAGE FORMING APPARATUS WITH MAIN AND AUXILIARY CLEANING DEVICE FOR CLEANING AN IMAGE BEARING SURFACE

(75) Inventors: Akira Matayoshi, Osaka (JP); Takeshi Watanabe, Osaka (JP); Hironori Daigo, Osaka (JP)

(73) Assignee: Kyocera Mita Corporation (JP)

( * ) Notice: Subject to any disclaimer, the term of this patent is extended or adjusted under 35 U.S.C. 154(b) by 448 days.

(21) Appl. No.: 12/121,886

(22) Filed: May 16, 2008

(65) Prior Publication Data

US 2008/0292349 A1 Nov. 27, 2008

(30) Foreign Application Priority Data

May 23, 2007 (JP) ..... 2007-137142
May 23, 2007 (JP) ..... 2007-137143

(51) Int. Cl.
*G03G 15/00* (2006.01)

(52) U.S. Cl. ..... 399/343; 399/71

(58) Field of Classification Search ..... 399/343–359, 399/71

See application file for complete search history.

(56) References Cited

U.S. PATENT DOCUMENTS 5,600,405 A 2/1997 Umeda et al.
6,311,031 B1 * 10/2001 Hirano ..... 399/101
2003/0118362 A1 * 6/2003 Akita et al. ..... 399/51
2004/0213598 A1 10/2004 Mori et al.
2005/0047816 A1 * 3/2005 Uchida et al. ..... 399/101
2006/0210310 A1 9/2006 Takahashi et al.

FOREIGN PATENT DOCUMENTS

JP 7-64444 3/1995
JP 2000-131969 5/2000
JP 2005-250411 9/2005

* cited by examiner

*Primary Examiner* — David M Gray
*Assistant Examiner* — G. M. Hyder
(74) *Attorney, Agent, or Firm* — Gerald E. Hespos; Michael J. Porco

(57) ABSTRACT

An image forming apparatus includes an image bearing member with an image bearing surface adapted to move in a given direction and carry a toner image thereon. A main cleaning device is opposed to the image bearing surface and electrically removes residual toner remaining on the image bearing surface. A power supply is adapted to apply to the main cleaning device a bias having a polarity reverse to a charge polarity of the residual toner. An auxiliary cleaning device is provided near and upstream of the main cleaning device with respect to the moving direction of the image bearing surface and can be brought into contact with the image bearing surface. A support structure supports the auxiliary cleaning device and permits the auxiliary cleaning device to be moved swingingly while following a displacement of the image bearing surface during the moving.

18 Claims, 8 Drawing Sheets

IMAGE FORMING APPARATUS WITH MAIN AND AUXILIARY CLEANING DEVICE FOR CLEANING AN IMAGE BEARING SURFACE

BACKGROUND OF THE INVENTION

1. Field of the Invention

The present invention relates to an image forming apparatus comprising a cleaning mechanism designed to clean up residual toner remaining on an image bearing surface.

2. Description of the Related Art

Heretofore, there has been known an image forming apparatus provided with a cleaning mechanism designed to remove and clean up residual toner remaining on a transfer belt serving as an image bearing member, as disclosed in JP 2000-131969A. This cleaning mechanism comprises a main cleaning device adapted to generally clean an image bearing region of the transfer belt which is being circulatingly moved, and an auxiliary cleaning device disposed in a vicinity of and on an upstream side relative to the main cleaning device.

The auxiliary cleaning device is adapted to locally clean the image bearing region in a specific zone corresponding to a mark image which is created on a widthwise part of the image bearing region to determine image forming conditions on the transfer belt. This cleaning mechanism allows even a specific zone having a locally increased cleaning load to be effectively subjected to a cleaning process, and therefore has a potential to achieve a more adequate cleaning process for the transfer belt.

However, the auxiliary cleaning device of the above cleaning mechanism is designed to simply perform a preliminary cleaning process only for the specific zone corresponding to the mark image in the transfer belt. This is not enough to reliably remove residual toner on the transfer belt. Moreover, the auxiliary cleaning device is fixed in an immovable manner relative to the transfer belt. Consequently, a contact pressure of the auxiliary cleaning device against the transfer belt will fluctuate depending on vibration of the transfer belt which is being circulatingly moved. The fluctuation in the contact pressure of the auxiliary cleaning device leads to a variation in cleaning performance of the auxiliary cleaning device, and thereby causes difficulty in uniformly removing residual toner on the transfer belt on a constant basis.

SUMMARY OF THE INVENTION

It is an object of the present invention to provide an image forming apparatus comprising a cleaning mechanism capable of adequately subjecting an image bearing surface of an image bearing member to a cleaning process.

In order to achieve this object, according to one aspect of the present invention, there is provided an image forming apparatus which comprises: an image bearing member having an image bearing surface adapted to move in a given direction and bear a toner image thereon; a main cleaning device disposed in opposed relation to the image bearing surface to electrically remove residual toner remaining on the image bearing surface; a power supply adapted to apply to the main cleaning device a bias having a polarity reverse to a charge polarity of the residual toner; an auxiliary cleaning device provided in a vicinity of and on an upstream side relative to the main cleaning device with respect to the moving direction of the image bearing surface, and adapted to be brought into contact with the image bearing surface; and a support structure which supports the auxiliary cleaning device in such a manner as to permit the auxiliary cleaning device to be swingingly moved while following a displacement of the image bearing surface during the moving.

DETAILED DESCRIPTION OF THE PREFERRED EMBODIMENTS

With reference to the drawings, the present invention will now be specifically described based on an embodiment thereof.

Figure 1:
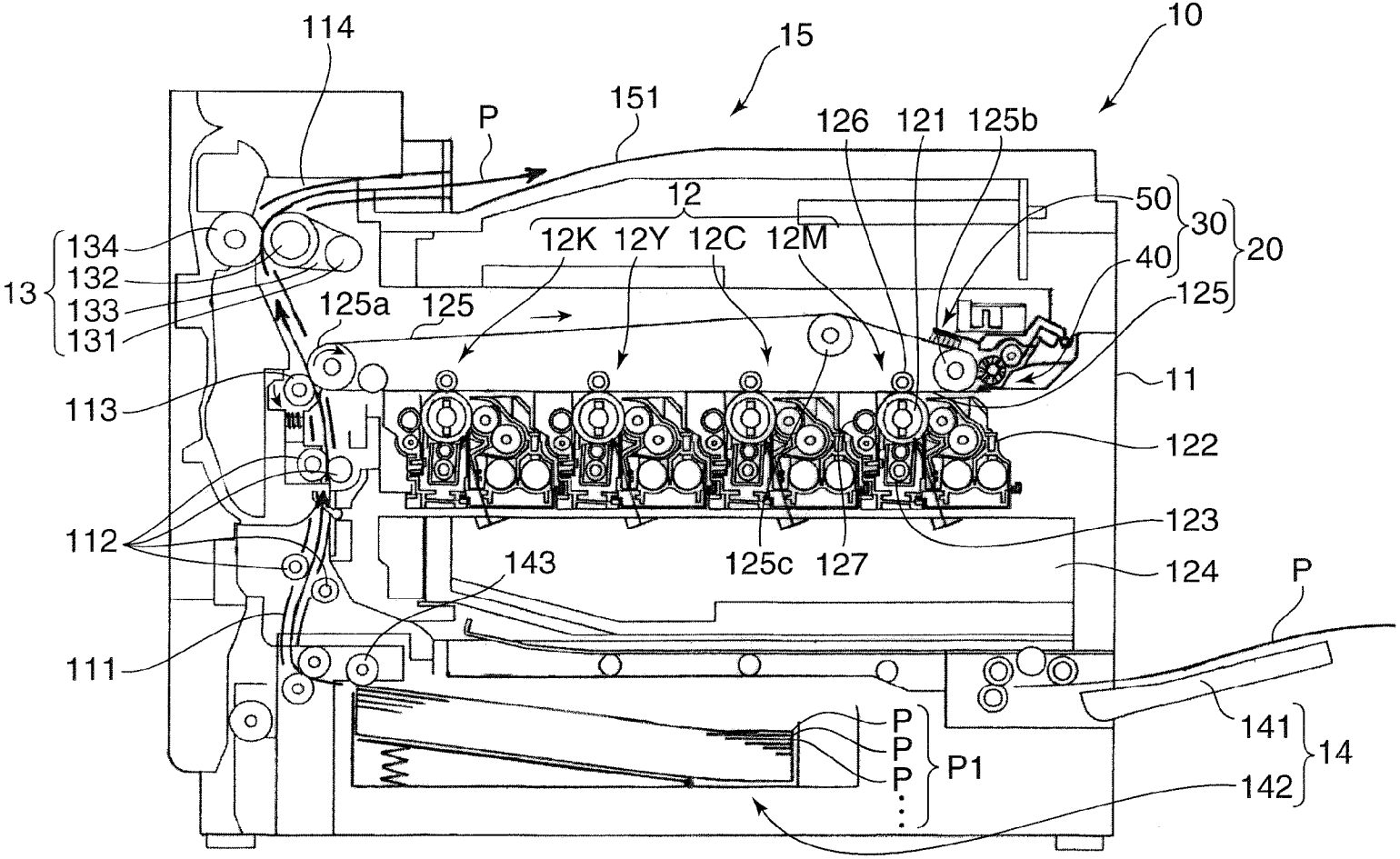
FIG. 1 is a front sectional view for explaining an internal structure of a printer according to one embodiment of the present invention.

First of all, an internal structure of a printer equipped with a belt cleaning mechanism, according to one embodiment of the present invention, will be schematically described with reference to FIG. 1. FIG. 1 is a front sectional view for explaining the internal structure of the printer.

The printer 10 (as one example of an image forming apparatus) according to this embodiment comprises an image forming section 12 operable to form an image based on image data transmitted from an external unit, such as a computer, a fixing section 13 operable to subject an image transferred onto a transfer sheet P after being formed by the image forming section 12, to a fixing process, a sheet storage section 14 adapted to store therein a plurality of transfer sheets P, and a box-shaped apparatus body 11 housing the above sections. The apparatus body 11 has an upper portion formed as a sheet discharge section 15 to which the sheet P after being subjected to the fixing process is ejected.

Although not illustrated, the printer 10 includes a manual operation panel provided at an appropriate position of a top surface of the apparatus body 11 to allow a user or operator to manually input an output condition of the sheet P and others. This manual operation panel is provided, but not shown, with a power key, a start button, and various keys for inputting the output condition.

The image forming section 12 is designed to form a toner image on the sheet P fed from the sheet storage section 14. In this embodiment, the image forming section 12 comprises a magenta unit 12M using magenta toner (i.e., developer), a cyan unit 12C using cyan toner, a yellow unit 12Y using yellow toner, and a black unit 12K using black toner, which are arranged in this order in a direction from an upstream side (right side in the drawing sheet of FIG. 1) toward an downstream side.

Each of the four units 12M, 12C, 12Y, 12K is provided with a photosensitive drum 121 and a developing device 122. The photosensitive drum 121 has an outer peripheral surface adapted to allow an electrostatic latent image and a toner image (visible image) in accordance with the electrostatic latent image to be formed thereon. In each of the four units, the photosensitive drum 121 is adapted to be supplied with a related one of the four colors of toners from the developing device 122, while being rotated in a counterclockwise (in FIG. 1) direction. The developing device 122 is adapted to be replenished with the toner from a toner cartridge disposed on the side of a front surface of the apparatus body 11 (on a front side relative to the drawing sheet of FIG. 1).

A so-called two-component developer comprising a toner and a carrier may be used as each of the developers. The toner is a fine powder prepared by dispersing additives, such as a colorant, a charge control agent and a wax, in a binder resin, to have a particle size of 6 to 12 μm. The carrier is magnetic particles made of magnetite ($Fe_3O_4$) or the like and formed to have a particle size of 60 to 200 μm, and used for electrostatically charging toner. The toner is a consumable supply to be appropriately replenished from the toner cartridge (not shown) to each of the developing devices 122, whereas the carrier is pre-filled into each of the developing devices 122 in a given amount, and cyclically used without being consumed.

In each of the four units, a charging device 123 is disposed immediately below the photosensitive drum 121. Further, in the image forming section 12, an exposing device 124 is disposed below the four charging devices 123. In each of the four units, the charging device 123 is operable to electrostatically charge the outer peripheral surface of the photosensitive drum 121 in a uniform manner. Then, the exposing device 124 is operable, based on image data input from a computer or the like, to emit four types of laser beams corresponding to the respective colors, onto the respective outer peripheral surfaces of the photosensitive drums 121. Through the charging process and the exposing process, an electrostatic latent image is formed on the outer peripheral surface of each of the photosensitive drums 121. Then, in each of the four units, the developing device 122 is operable to supply the toner to the electrostatic latent image so as to form a toner image on the outer peripheral surface of the photosensitive drum 121.

A transfer belt 125 (serving as an image bearing member) is disposed above the four photosensitive drums 121. The transfer belt 125 is wound around between a left (in FIG. 1) driving roller 125*a* (serving as a second roller) and a right (in FIG. 1) driven roller 125*b* (serving as a first roller), in such a manner that an outer surface of the transfer belt 125 has an upwardly facing region and an downwardly facing region, wherein each of the photosensitive drums 121 is in contact with the downwardly facing outer surface region. Specifically, the transfer belt 125 is adapted to be circulatingly moved (i.e., move in a circulating manner) between the driving roller 125*a* and the driven roller 125*b* in synchronization with the photosensitive drums 121, while being pressed against the respective outer peripheral surfaces of the photosensitive drums 121 by four first transfer rollers 126 disposed correspondingly to the respective photosensitive drums 121. The outer surface of the transfer belt 125 is formed to serve as an image bearing surface, and a moving direction of the image bearing surface is reversed at respective positions of the driving roller 125*a* and the driven roller 125*b*.

In this embodiment, a tension roller 125*c* is disposed between the driving and driven rollers 125*a*, 125*b* positioned in horizontally spaced-apart relation to each other, at a position closer to the driven roller 125*b* than the driving roller 125*a* and slightly above the driven roller 125*b*. The tension roller 125*c* is designed to give tension to the transfer belt 125, and urged upwardly by an urging force of an urging member (not shown). The upwardly facing outer surface region of the transfer belt 125 is pushed upwardly by the tension roller 125*c*, and thereby deformed into a chevron shape having a peak at the position of the tension roller 125*c*.

According to the circulating moving of the transfer belt 125, a magenta toner-based toner image (i.e., magenta toner image) formed on the photosensitive drum 121 of the magenta unit 12M is firstly transferred onto the outer surface (i.e., image bearing surface) of the transfer belt 125. Subsequently, a cyan toner image formed on the photosensitive drum 121 of the cyan unit 12C, a yellow toner image formed on the photosensitive drum 121 of the yellow unit 12Y, and a black toner image formed on the photosensitive drum 121 of the black unit 12K, are sequentially transferred to a position of the transferred magenta toner image in a superimposed manner. Through the primary transfer process, a color toner image is formed on the outer surface of the transfer belt 125. This color toner image will be transferred onto the sheet P transported from the sheet storage section 14.

In each of the four units, a drum cleaning device 127 is disposed on a left (in FIG. 1) side of the photosensitive drum 121 to remove and clean up residual toner on the outer peripheral surface of the photosensitive drum 121. The outer peripheral surface of the photosensitive drum 121 after being subjected to the cleaning process by the drum cleaning device 127 will be rotated toward the charging device 123 to perform a new charging process. The waste toner removed from the outer peripheral surfaces of the photosensitive drums 121 is collected to a toner collection bottle via a given path.

A sheet transport passage 111 is formed on a left (in FIG. 1) side relative to the image forming section 12 to extend in an upward/downward direction. The sheet transport passage 111 has a transport roller pair 112 disposed at an appropriate position. According to driving of the transport roller pair 112, the sheet P sent from the sheet storage section 14 is transported toward the image forming section 12. Further, the sheet transport passage 111 has a second transfer roller 113 disposed at a position opposed to the driving roller 125*a* while being kept in contact with the outer surface of the transfer belt 125. Thus, the sheet P being transported through the sheet transport passage 111 is pressed and nipped between the transfer belt 125 and the second transfer roller 113, so that the toner image on the transfer belt 125 is transferred onto the sheet P.

The fixing section 13 is operable to subject the sheet having the toner image transferred in the image forming section 12, to a fixing process. The fixing section 13 comprises a heating roller 131 internally provided with an electrical heating element serving as a heating source, a fixing roller 132 disposed on a left (in FIG. 1) side of and in opposed relation to the heating roller 131, a fixing belt 133 wound around between the fixing roller 132 and the heating roller 131 in a tensioned manner, and a pressing roller 134 disposed in opposed relation to the fixing roller 132 while interposing the fixing belt 133 therebetween.

Thus, the sheet P supplied to the fixing section 13, with the toner image transferred from the transfer belt 125 during the course of passing through a nip zone defined between the transfer belt 125 and the second transfer roller 113, is subjected to the fixing process in such a manner that it receives heat from the fixing belt 133 while passing through between the pressing roller 134 and the high-temperature fixing belt 133.

The sheet P after completion of the fixing process is transported through a sheet ejection passage 114 extending from an upper portion of the fixing section 13, and ejected to a catch tray 151 of the sheet discharge section 15 provided on the top surface of the apparatus body 11.

The sheet storage section 14 includes a manual feed tray 141 provided to a right (in FIG. 1) wall of the apparatus body 11 in an openable/closable manner, and a sheet tray 142 mounted inside the apparatus body 11 at a position below the exposing device 124, in an insertable/extractable manner. The sheet tray 142 is adapted to store therein a sheet stack, i.e., a plurality of stacked sheets P.

The manual feed tray 141 is used for manually feeding the sheet P toward the image forming section 12 on a one-by-one basis. The manual feed tray 141 is normally retracted in the right wall of the apparatus body 11 (i.e., set at a closed position), and, in a manual sheet feed mode, extracted from the wall (i.e., set at an open position) to manually feed the sheet P.

The sheet tray 142 comprises a box-shaped casing formed to have a fully-opened upper surface and store therein a sheet stack, i.e., a plurality of stacked sheets P. According to driving of a pickup roller 143, an upper surface of a downstream (left end in FIG. 1) end of an uppermost sheet P in the sheet stack stored in the sheet tray 142 is moved toward the sheet transport passage 111. The sheet P picked up from the sheet tray 142 on a one-by-one basis is fed toward the nip zone defined between the second transfer roller 113 and the transfer belt 125 in the image forming section 12, through the sheet transport passage 111, according to the driving of the transport roller pair 112.

In this embodiment, in order to remove and clean up residual toner remaining on the upwardly facing outer surface region of the transfer belt 125, after completion of a secondary transfer process (in which the color image on the downwardly facing outer surface region of the transfer belt 125 is transferred onto the sheet P in the nip portion defined between the transfer belt 125 and the second transfer roller 113), a belt cleaning mechanism 30 is provided at a position corresponding to the driven roller 125*b* (see FIG. 1).

In this embodiment, the driving roller 125*a*, the driven roller 125*b*, the tension roller 125*c*, the transfer belt 125 wound around these rollers, the first transfer rollers 126, and the belt cleaning mechanism 30, are unitized as a single intermediate transfer unit 20.

Figure 2:
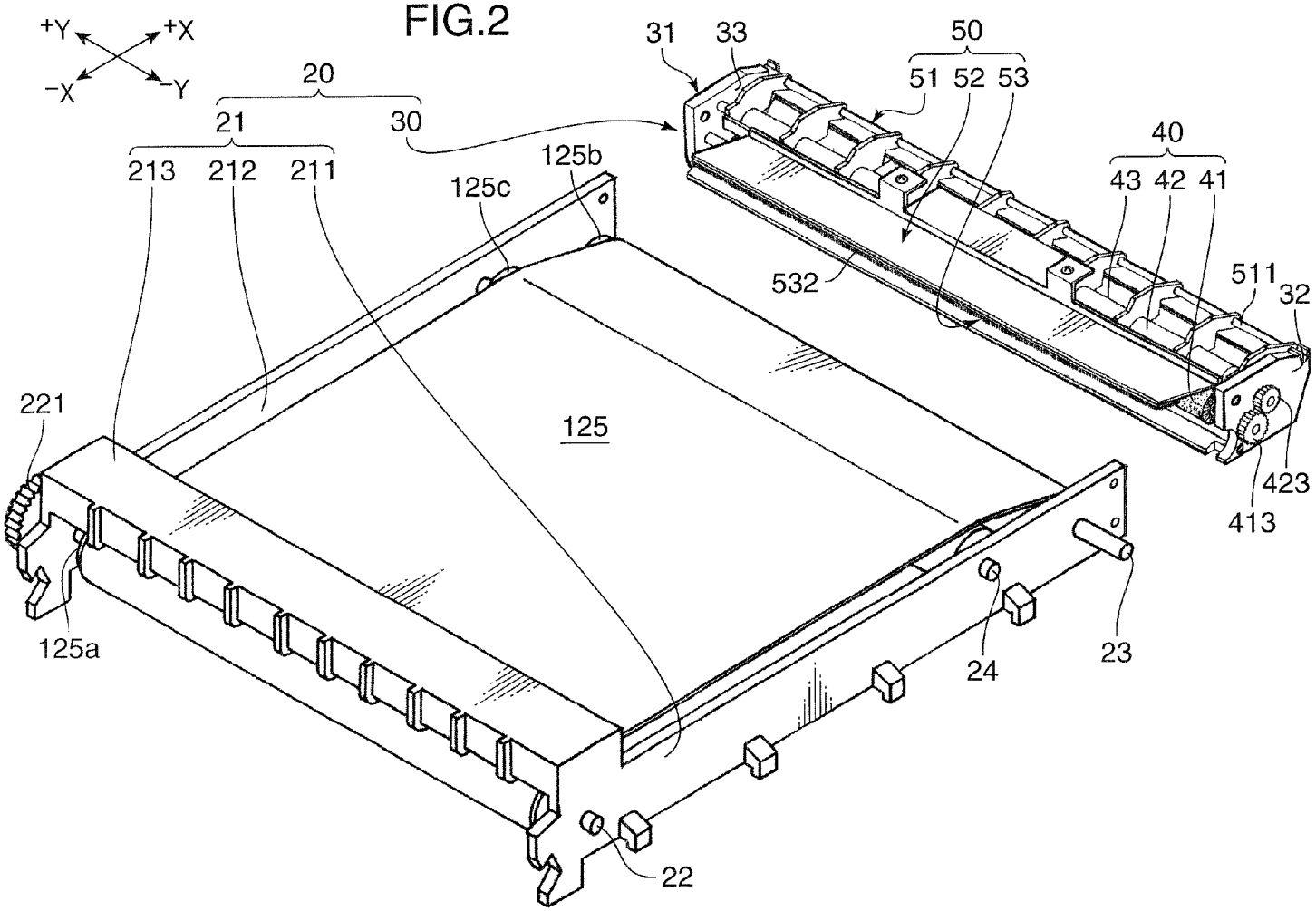
FIG. 2 is a perspective view showing one example of an intermediate transfer unit in a state when a belt cleaning mechanism is demounted from a unit frame.
Figure 3:
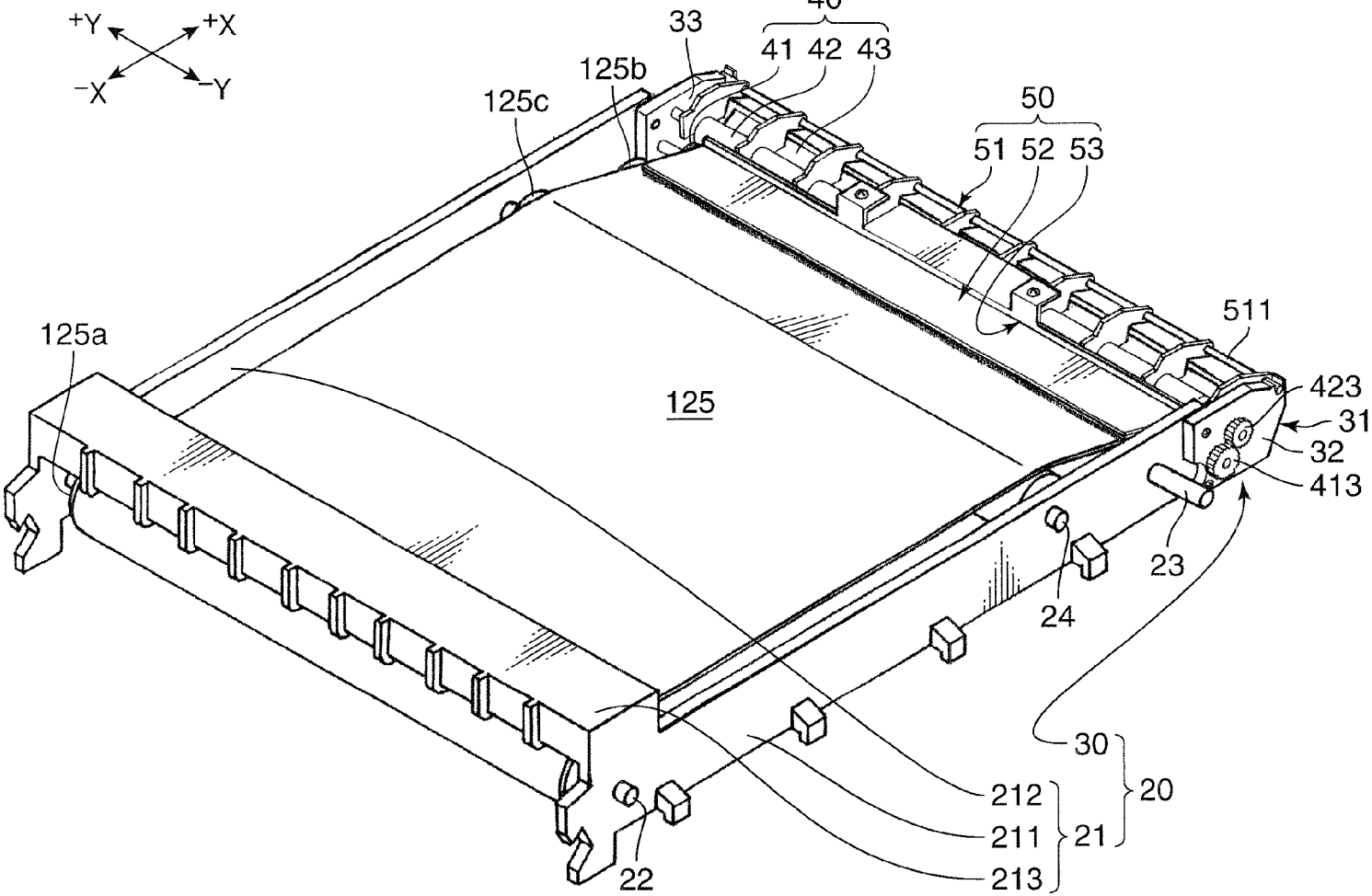
FIG. 3 is a perspective view showing the intermediate transfer unit in a state after the belt cleaning mechanism illustrated in FIG. 2 is mounted to the unit frame.

With reference to FIGS. 2 and 3, the intermediate transfer unit 20 will be described below. FIGS. 2 and 3 are perspective views showing one example of the intermediate transfer unit 20, wherein FIG. 2 shows a state when the cleaning mechanism 30 is demounted from a unit frame 21, and FIG. 3 shows a state after the cleaning mechanism 30 is mounted from the unit frame 21. In FIG. 2, the X-X direction and the Y-Y direction will hereinafter be referred to as "rightward/leftward direction" and "frontward/rearward direction", respectively. In particular, the −X direction, the +X direction, the −Y direction, and the +Y direction, will hereinafter be referred to as "leftward (or left)", "rightward (or right)", "frontward (or front)" and "rearward (or rear)", respectively.

This intermediate transfer unit 20 comprises: a unit frame 21; a set of rollers consisting of a driving roller 125*a*, a driven roller 125*b* and a tension roller 125*c* each mounted to the unit frame 21; a transfer belt 125 wound around the three rollers; and a belt cleaning mechanism 30.

The unit frame 21 includes a front frame 211 elongated in the rightward/leftward direction, a rear frame 212 disposed on a rearward side relative to and in opposed relation to the front frame 211 and formed in approximately the same shape as that of the front frame 211, and a bridge frame 213 disposed between respective left ends of upper edges of the front and rear frames 211, 212 in a bridging manner. Each of the front and rear frames 211, 212 is designed to have a length dimension such that it extends across the image forming section 12 in the rightward/leftward direction and within the apparatus body 11, and the bridge frame 213 is designed to have a length dimension in the frontward/rearward direction which is slightly greater than a belt width of the transfer belt 125.

A driving roller shaft 22 is rotatably installed between the front and rear frames 211, 212 at a position immediately below the bridge frame 213. The driving roller 125*a* is coaxially fitted onto the driving roller shaft 22 in an integrally rotatable manner. A driven shaft 23 is installed between respective right ends of the front and rear frames 211, 212. The driven roller 125*b* is coaxially fitted onto the driven shaft 23 in a rotatable manner about the driven shaft 23.

A tension roller shaft 24 is installed between the front and rear frames 211, 212 at a position on a slightly leftward side relative to the driven shaft 23. The tension roller 125*c* is coaxially fitted onto the tension roller shaft 24 in a rotatable manner about the tension roller shaft 24. The transfer belt 125 is wound around the driving roller 125*a*, the driven roller 125*b* and the tension roller 125*c*.

A driving gear 221 is coaxially attached to a rear end of the driving roller shaft 22 in an integrally rotatable manner. The driving gear 221 is adapted to transmit a driving force from a driving motor (not shown) to the driving roller shaft 22 therethrough, so that the driving roller 125 is drivenly rotated to circulatingly move the transfer belt 125 in a clockwise direction when viewed frontwardly (i.e., −Y direction).

Figure 4:
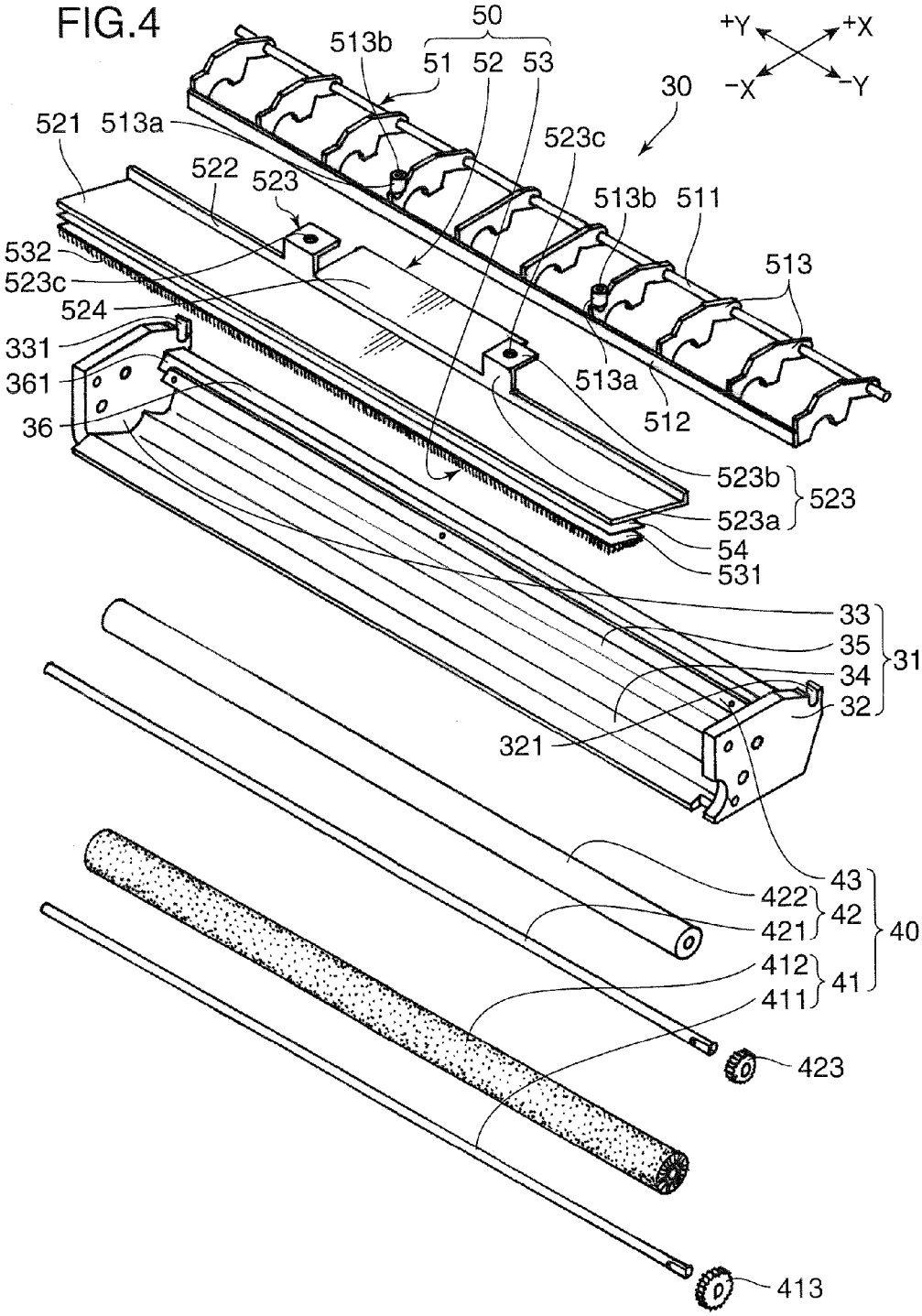
FIG. 4 is an exploded perspective view showing one example of the belt cleaning mechanism.
Figure 5:
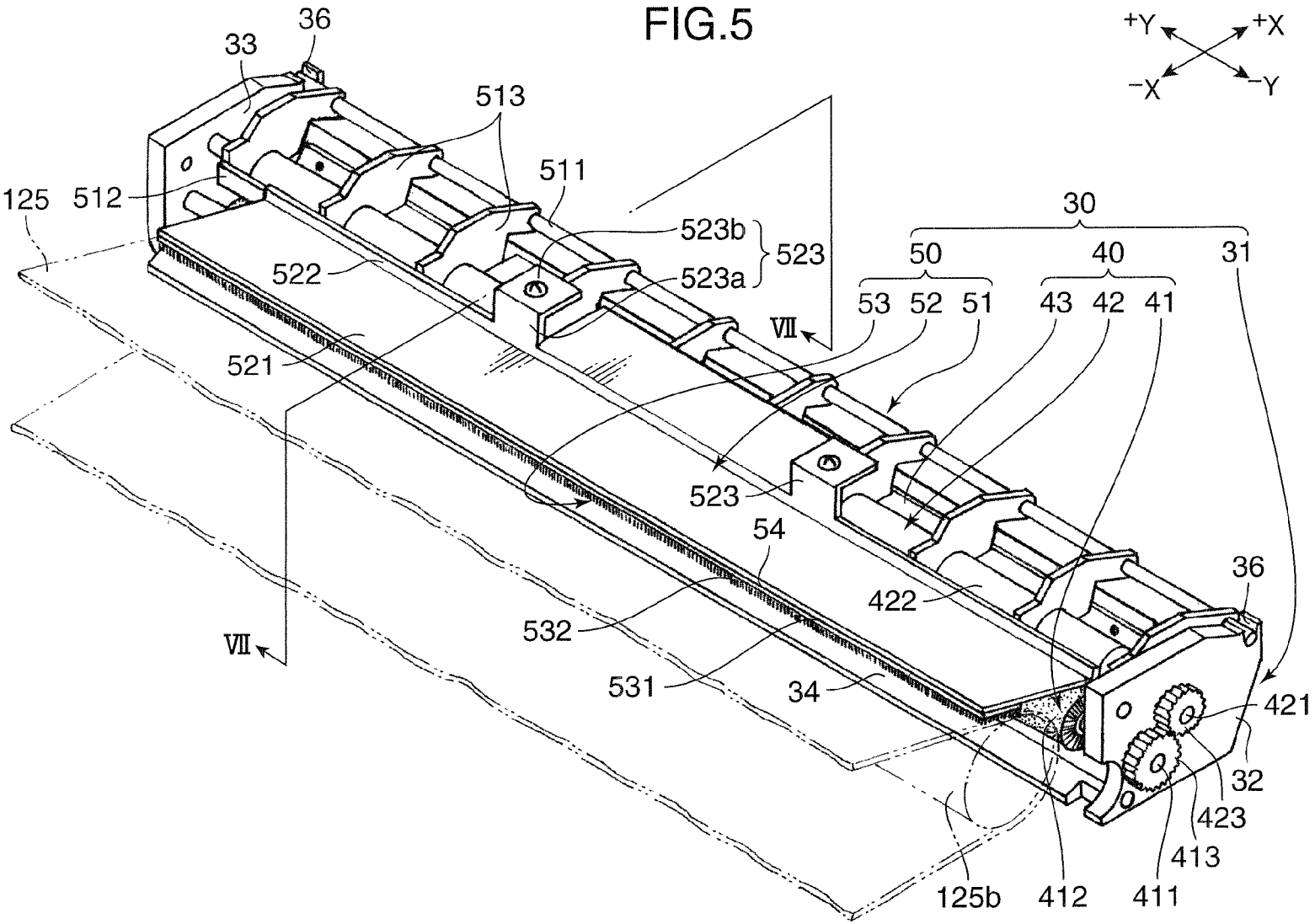
FIG. 5 is a perspective view showing the belt cleaning mechanism in a state after a bar brush is positioned in a closed posture.
Figure 6:
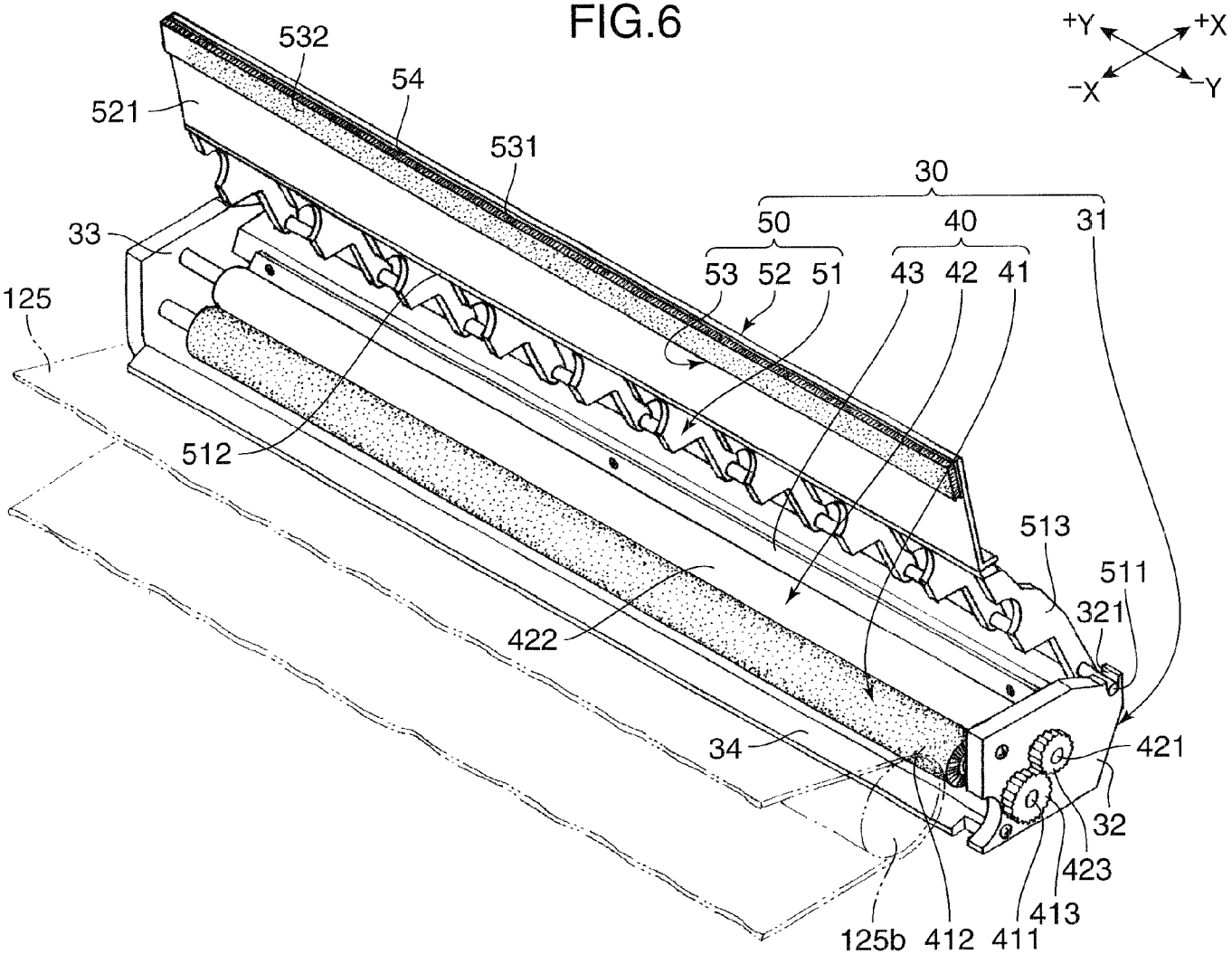
FIG. 6 is a perspective view showing the belt cleaning mechanism in a state after the bar brush is positioned in an open posture.
Figure 7:
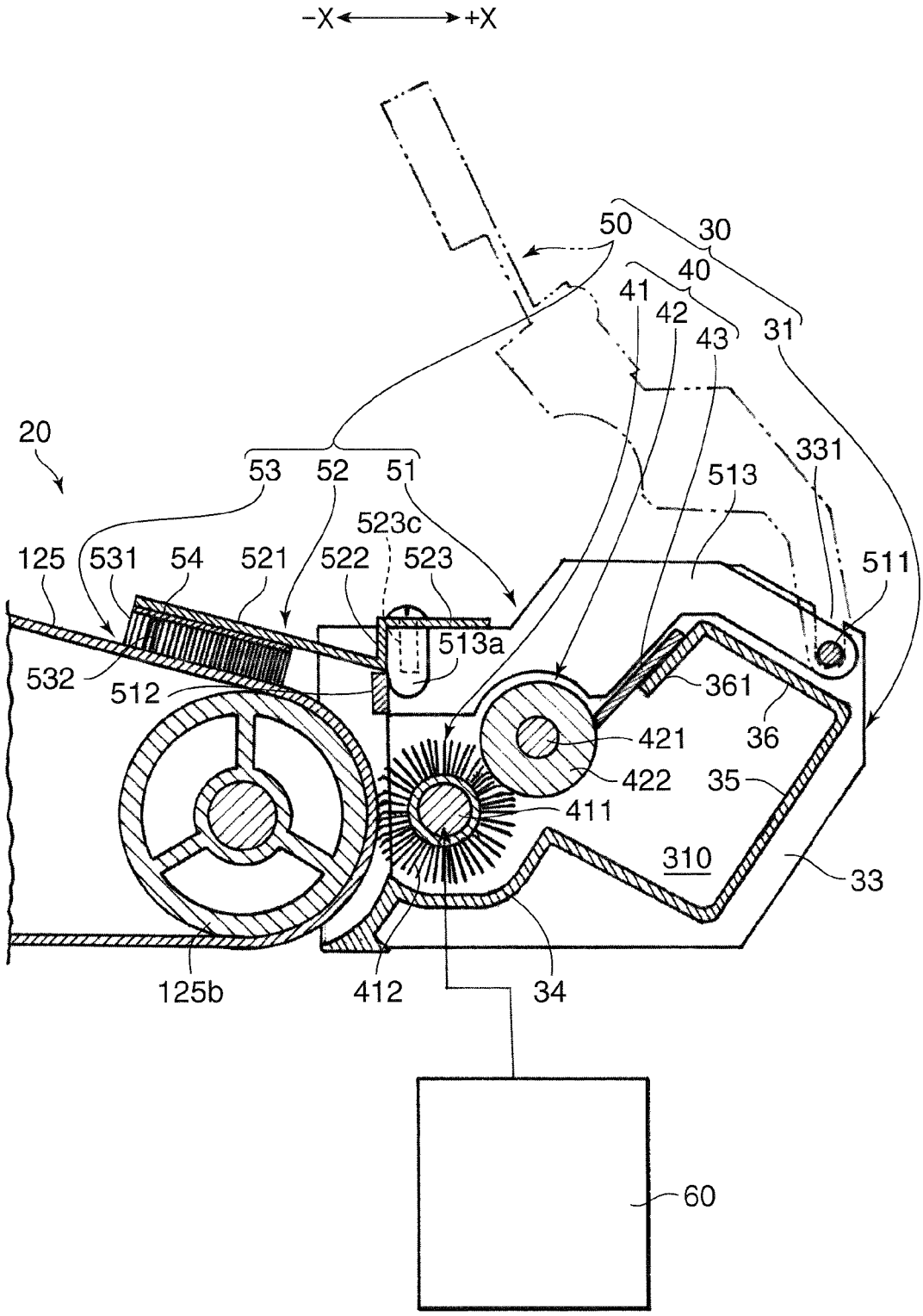
FIG. 7 is a sectional view taken along the line VII-VII in FIG. 5.

The belt cleaning mechanism 30 is mounted between respective right ends of the front and rear frames 211, 212 in the intermediate transfer unit 20. With reference to FIGS. 4 to 7, the belt cleaning mechanism 30 will be specifically described below. FIG. 4 is an exploded perspective view of the belt cleaning mechanism 30, and FIGS. 5 and 6 are perspective views of the belt cleaning mechanism 30 in an assembled state. Specifically, FIG. 5 shows a state after an auxiliary cleaning device 50 is positioned in a closed posture, and FIG. 6 shows a state after the auxiliary cleaning device 50 is positioned in an open posture. FIG. 7 is a sectional view taken along the line VII-VII in FIG. 5. As to a directional indication using "X" and "Y" in FIGS. 4 to 7, the X-X direction and the Y-Y direction indicate "rightward/leftward direction" ("−X": leftward (or left), "+X": rightward (or right)) and "frontward/rearward direction" ("−Y": frontward (or front), "+Y": rearward (or rear)), respectively, in the same manner as that in FIG. 2.

As shown in FIG. 4, the belt cleaning mechanism 30 comprises a casing 31 adapted to be mounted to the unit frame 21, a main cleaning device 40 adapted to electrically remove residual toner on an outer surface of the transfer belt 125, and an auxiliary cleaning device 50 positioned in a vicinity of and on an upstream side relative to the main cleaning device 40 with respect to a circulating direction of the transfer belt 125, wherein the main cleaning device 40 and the auxiliary cleaning device 50 are attached to the casing 31.

The casing 31 includes a front plate 32, a rear plate 33 disposed on a rearward side relative to and in opposed relation to the front plate 32, a bottom plate 34 disposed between respective lower edges of the front and rear plates 32, 33 in a bridging manner, a right plate 35 disposed between respective right edges of the front and rear plates 32, 33 in a bridging manner, and a top plate 36, wherein a left side of the casing 31 is opened. The casing 31 is fixedly screwed to the unit frame 21 while bringing an inner surface of the front plate 32 into contact with an outer surface of the right end of the front frame 211, and bringing an outer surface of the rear plate 33 into contact with an inner surface of the right end of the rear frame 212.

The main cleaning device 40 includes a fur brush 41 having an outer peripheral surface adapted to be brought into contact with the outer surface of the transfer belt 125, a collection roller 42 having an outer peripheral surface adapted to be brought into contact with the outer peripheral surface of the fur brush 41, and a blade 43 adapted to scrape off residual toner collected to the outer peripheral surface of the collection roller 42.

The fur brush 41 includes a brush shaft 411, and a fur brush body 412 fitted onto the brush shaft 411 in an integrally rotatable manner. The fur brush body 412 is prepared by uniformly implanting bristles in an outer peripheral surface of a tube member made of a synthetic resin and formed to allow the brush shaft 411 to be fittingly inserted thereinto. The fur brush 41 is mounted to the casing 31 by arranging the fur brush body 412 at a given lower left position between the front and rear plates 32 and 33, and inserting the brush shaft 411 into the fur brush body 412 while allowing the brush shaft 411 to penetrate through each of the front and rear plates 32, 33.

In this embodiment, the fur brush body 412 is designed to have an outer diameter dimension of 17 mm. The bristles employed in the fur brush body 412 are made of polyamide and formed to have a fineness of 6 denier. Each of the bristles is designed to have a length dimension of 4.5 mm, and brought into contact with the outer surface of the transfer belt 125 to allow a nip dimension thereof to be set at 1 mm. Further, the bristles are implanted at a density of 120 KF/inch$^2$. Just for information, the fur brush body 412 has an electrical resistance of $1\times10^{11.5}\Omega$. The bristles are applied with a bias current of −20 μA from an electric power unit 60 (i.e., power supply) illustrated in FIG. 7. According to an electrical attraction force arising from the application of the negative bias, positively-charged residual toner on the transfer belt 125 is moved from the transfer belt 125 to the fur brush body 412.

The collection roller 42 includes a collection roller shaft 421, and a collection roller body 422 made of an elastomer, such as a rubber or a soft synthetic resin, and coaxially fitted onto the collection roller shaft 421 in an integrally rotatable manner. The collection roller 42 is mounted to the casing 31 by arranging the collection roller body 422 at a position between the front and rear plates 32, 33 and on an obliquely upward and rightward side relative to the fur brush 41, and inserting the collection roller shaft 421 into the collection roller body 422 while allowing the collection roller shaft 421 to penetrate through each of the front and rear plates 32, 33. An installation position of the collection roller 42 in a state after being mounted to the casing 31 is set to allow an outer peripheral surface of the collection roller 42 to interfere with the fur brush body 412 of the fur brush 41.

In a state after the brush shaft 411 is mounted to the casing 31, a brush shaft-side gear 413 is coaxially fitted onto a front end of the brush shaft 411 in an integrally rotatable manner. In a state after the collection roller shaft 421 is mounted to the casing 31, a collection roller shaft-side gear 423 is coaxially fritted onto a front end of the collection roller shaft 412 in an integrally rotatable manner. Each of the two gears 413, 423 is designed to have a radial dimension for allowing mesh engagement therebetween.

The brush shaft-side gear 413 is adapted to be rotated by a driving force transmitted from a driving motor (not shown) thereto, so that the fur brush 41 is rotated about the brush shaft 411 in conjunction with the rotation of brush shaft-side gear 413. Thus, according to rotation of the collection roller shaft-side gear 423 in mesh engagement with the brush shaft-side gear 413, the collection roller 42 is rotated about the collection roller shaft 421 in a direction opposite to that of the fur brush 41.

The blade 43 is designed to scrape off residual toner moved from the bristles of the fur brush 41 to the outer peripheral surface of the collection roller 42. The blade 43 is fixedly screwed to an inclined plate 361 which extends from a left edge of the top plate 36 of the casing 31 in an obliquely downwardly inclined posture toward the leftward direction, so that a lower edge of the blade 43 is brought into contact with an outer peripheral surface of the collection roller body 422. Thus, when the collection roller 42 is rotated about the collection roller shaft 421 in a counterclockwise direction, residual toner attached on the outer peripheral surface of the collection roller body 422 will be scraped off by the blade 43, and collected to a collected-toner trapping space 310 of the casing 31.

The auxiliary cleaning device 50 is designed to subject the outer surface (i.e., image bearing surface) of the transfer belt 125 to a brushing process, in advance of the cleaning process by the main cleaning device 40. Through the brushing process, residual toner attached on the outer surface of the transfer belt 125 is detached or pulled apart from the transfer belt 125. This makes it possible to more effectively remove the residual toner from the transfer belt 125.

The auxiliary cleaning device 50 includes a ladder-structured frame 51 rotatably mounted to an upper surface of the casing 31, a brush bracket 52 fixed to the ladder-structured frame 51 (a combination of the ladder-structured frame 51 and the brush bracket 52 serves as a frame member), and a bar brush 53 (as one example of a cleaner) mounted to the brush bracket 52.

The ladder-structured frame 51 includes a columnar-shaped frame 511 extending in the frontward/rearward direction, a rectangular-shaped frame 512 disposed on a leftward side relative to and in opposed relation to the columnar-shaped frame 511 to extend in the frontward/rearward direction, and a plurality of bridge plates 513 disposed at a given pitch between the columnar-shaped frame 511 and the rectangular-shaped frame 512 in a bridging manner to extend in the rightward/leftward direction. Each of the bridge plates 513 is designed to have a length dimension (in the frontward/rearward direction) which is slightly less than that of each of the front and rear plates 32, 33. While a total number of the bridge plates 513 in this embodiment is set at ten, the total number may be appropriately set at any other suitable value depending on the situation.

The columnar-shaped frame 511 is designed to have a length dimension approximately equal to an external dimension between the front and rear plates 32, 33 of the casing 31, whereas the rectangular-shaped frame 512 is designed to have a length dimension slightly less than an internal dimension between the front and rear plates 32, 33. Thus, in a state after the columnar-shaped frame 511 and the rectangular-shaped frame 512 are connected to each other through the plurality of bridge plates 513, the columnar-shaped frame 511 has opposite ends protruding outwardly from frontmost and rearmost ones of the bridge plates 513, respectively.

Correspondingly, a right end of the upper edge in each of the front and rear plates 32, 33 is concaved downwardly to form a fitting groove (321, 331) (serving as a support structure) adapted to fittingly receive therein a corresponding one of the ends of the columnar-shaped frame 511. Thus, in a state after the ends of the columnar-shaped frame 511 are fitted into respective ones of the fitting grooves 321, 331, the ladder-structured frame 51 can be rotated integrally with and about the columnar-shaped frame 511. This support structure rotatably supporting the ladder-structured frame 51 in the above manner permits the auxiliary cleaning device 50 (particularly the bar brush 53) to be swingingly moved in an upward/downward direction while following a displacement of the image bearing surface of the transfer belt 125 which is circulatingly moving.

The brush holder 52 includes a mounting plate 521 elongated in the frontward/rearward direction, a line-shaped edge dam 522 formed by bending a right edge of the mounting plate 521 upwardly over an entire length thereof, a pair of front and rear brackets 523 protruding, respectively, from two symmetrical positions of the line-shaped edge dam 522 in the frontward/rearward direction, and an extension plate 524 extending rightwardly from a region of the line-shaped edge dam 522 between the front and rear brackets 523.

The brackets 523 are fixed to respective positions corresponding to two 4th ones of the bridge plates 513 counted from the frontmost and rearmost bridge plates 513. Each of the brackets 523 is formed in a hook shape bent at a right angle when viewed from a front side thereof (i.e., −Y direction), to have a projecting portion 523*a* projecting outwardly from the line-shaped edge dam 522, and a bent portion 523*b* bent rightwardly from a distal edge of the projecting portion 523*a*. Each of the bent portions 523*b* is formed with a through-hole 523*c*.

Correspondingly, the ladder-structured frame 51 is provided with a pair of columnar members 513*a* which project upwardly from respective left ends of the 4th bridge plate 513 counted from the frontmost bridge plate 513 and the 4th bridge plate 513 counted from the rearmost bridge plate 513. Each of the columnar members 513*a* has a threaded hole formed in an upper surface thereof in corresponding relation to a respective one of the through-holes 523*c* of the bracket 523. The brush holder 52 is mounted to the ladder-structured frame 51, as shown in FIG. 5, by placing the respective bent portions 523*b* of the brackets 523 on the corresponding columnar members 513*a*, inserting a given screw into each of the through-hole 523*c*, and fasteningly driving the screw into the threaded hole 513*b*. That is, the ladder-structured frame 51 and the brush holder 52 are fastened together as an integral frame member, which is swingingly movable in the upward/downward direction about the columnar-shaped frame 511 serving as a pivot shaft.

The brush holder 52 is dimensionally designed such that, in a state after the auxiliary cleaning device 50 is mounted to the casing 31, a left end of the brush holder 52 can be disposed in opposed relation to a given position on the upwardly facing outer surface region of the transfer belt 125 and between the driven roller 125*b* and the tension roller 125*c*.

The extension plate 524 of the brush holder 52 is brought into contact with respective upper edge surfaces of two central ones of the bridge plates 513. This prevents the brush holder 52 from being swingingly rotated about an upper end of the projecting portion 523*a*, in a clockwise direction in front view.

The bar brush 53 is prepared by implanting a large number of bristles 532 in a lower surface of a base sheet 531 made of a synthetic resin. The base sheet 531 is designed to have a length dimension in the frontward/rearward direction which is equal to that of the mounting plate 521, and a width dimension in the rightward/leftward direction which is approximately one-half of that of the mounting plate 521. In this embodiment, the bar brush 53 is attached to a left half region of a lower surface of the mounting plate 521 through an electrical-insulating tape 54 having an adhesive layer on each of front and rear surfaces, so-called "electrical-insulating two-sided adhesive tape" (serving as an electrical insulating member).

In this embodiment, the bar brush 53 is designed to have a width dimension of 15 mm in the rightward/leftward direction, and a length dimension of 310 mm in the frontward/rearward direction, in top plan view. In this embodiment, the bristles 532 employed in the bar brush 53 are made of polyamide and formed to have a fineness of 6 denier. Each of the bristles 532 is designed to have a length of 4.5 mm, and the bristles 532 are implanted at a density of 120 KF/inch$^2$. Just for information, the bar brush 53 has an electrical resistance of $1\times10^{11.5}\Omega$. In this embodiment, the auxiliary cleaning device 50 is designed to have a total weight of 280 g.

The above auxiliary cleaning device 50 is mounted to the casing, as shown in FIG. 5, by fitting the ends of the columnar-shaped frame 511 into the corresponding fitting grooves 321, 331 of the front and rear plates 32, 33 of the casing 31. In a state after the auxiliary cleaning device 50 is mounted to the casing 31 and then positioned in a closed posture as shown in FIG. 5, the bristles 532 of the bar brush 53 are in contact with the outer surface of the transfer belt 125 at position in a vicinity of and on a left side of the driven roller 125*b*.

Then, when the auxiliary cleaning device 50 positioned in the closed posture is swingingly moved about the columnar-shaped frame 511 in the clockwise direction, the posture of the auxiliary cleaning device 50 is changed to an open posture, as shown in FIG. 6. Thus, the components housed in the casing 31, such as the fur brush 41 and the collection roller 42, are exposed outside the casing 31. In this state, a given maintenance operation is performed according to need.

When the auxiliary cleaning device 50 is positioned in the closed posture, the auxiliary cleaning device 50 is supported by the fitting grooves 321, 331 of the front and rear plates 32, 33 of the casing 31, and a portion of the upwardly facing outer surface region of the transfer belt 125 located in the vicinity of the driven roller 125*b*. That is, the auxiliary cleaning device 50 presses the outer surface of the transfer belt 125 by its own weight. Thus, a pressing force of the bar brush 53 against the outer surface of the transfer belt 125 relies on the weight of the auxiliary cleaning device 50. This pressing force has a functional relationship with a position of a gravity center of the auxiliary cleaning device 50 in the rightward/leftward direction.

Specifically, given that a total weight of the auxiliary cleaning device 50, an effective length of the auxiliary cleaning device 50 in the rightward/leftward direction (i.e., a distance between a center line of the bar brush 53 in the rightward/leftward direction and a groove center line connecting the fitting grooves 321, 331), a distance between the position of the gravity center of the auxiliary cleaning device 50 in the rightward/leftward direction and the center line of the bar brush 53 in the rightward/leftward direction, and a distance between the position of the gravity center of the auxiliary cleaning device 50 in the rightward/leftward direction and the groove center line connecting the fitting grooves 321, 331, are W, L, L1, and L2, respectively, a pressing force W1 of the bristles 532 of the bar brush 53 against the transfer belt 125 is expressed as the following formula (1):

$$W1=(L2/L)\times W \quad (1)$$

A pressing force W2 of the ladder-structured frame 51 against groove bottoms of the fitting grooves 321, 331 is expressed as the following formula (2):

$$W2=(L1/L)\times W \quad (2)$$

Thus, for example, in cases where the position of the gravity center of the auxiliary cleaning device 50 in the rightward/leftward direction is located just in the middle (i.e., L2=L1), the pressing force W1 of the bristles 532 of the bar brush 53 against the transfer belt 125 is calculated as "W/2" according to the formula (1). In this embodiment, the total weight of the auxiliary cleaning device 50 is 280 g, and therefore the bristles 532 press the outer surface of the transfer belt 125 by a pressing force of one-half of 280 g, i.e., 140 g. In the structure where the auxiliary cleaning device 50 is supported by the front and rear plates 32, 33 in a swingingly movable manner about the columnar-shaped frame 511 as in this embodiment, the "140 g" is a weight of the auxiliary cleaning device 50 itself in the present invention to be imposed on the transfer belt 125.

In the above structure, the transfer belt 125 is likely to wobble up and down while being driven to move circulatingly, to cause up-and-down wobbling in the image bearing surface (i.e., outer surface) of the transfer belt 125. The reason is that the tension roller 125*c* giving tension to the transfer belt 125 is urged upwardly by an urging force of the urging member (not shown), and likely to be displaced up and down, for example, during starting of the circulating movement of the transfer belt 125, to cause up-and-down displacement in the transfer belt 125.

In this embodiment, even if a portion of the transfer belt 125 in contact with the bristles 532 is displaced up and down, the auxiliary cleaning device 50 is swingingly moved bi-directionally about the columnar-shaped frame 511 while following the displacement, to prevent a change in the pressing force of the bristles 532 against the transfer belt 125. This makes it possible to maintain a condition that the outer surface of the transfer belt 125 is pressed by a constant pressing force from the bristles 532, so as to reliably prevent the occurrence of an undesirable situation where the pressing force of the bristles 532 is changed due to a displacement of the transfer belt 125, to cause a variation in brushing performance.

Further, in this embodiment, the bar brush 53 is placed in an electrically floating state. Specifically, the bar brush 53 is supported by the brush holder 52 through the electrical-insulating two-sided adhesive tape 54, so that it is isolated from an electrical system of the printer 10. Thus, no voltage is applied to the bar brush 52. In addition, the bar brush 52 is not electrically connected to a grounding system. This is made for the following reason.

Typically, a toner image formed on the outer surface of the transfer belt 125 is charged at +20 to +30 μc/g. As long as the amount of charges is maintained at such a level, toner on the transfer belt 125 can be electrically peeled from the transfer belt 125 without any difficulty, by giving charges having a polarity opposite to that of the toner, from the main cleaning device 40. However, when the toner image on the transfer belt 125 is moved to a position opposed to the second transfer roller 113, the toner image receives charges having the opposite polarity from the second transfer roller 113, and thereby tends to have an electrically reversed polarity. Consequently, the charge amount of residual toner remaining on the transfer belt 125 after passing through the second transfer roller 113 is lowered to about +5 μc/g.

If the residual toner having a low charge amount of about +5 μc/g is applied with a negative voltage having the opposite polarity from the auxiliary cleaning device 50, or grounded, the residual toner is excessively treated to have an extremely low charge state or a negative charge state. Thus, when the residual toner reaches the fur brush 41 in this state according to the circulating movement of the transfer belt 125, the fur brush 41 cannot effectively attract and remove the residual toner, although the fur brush 41 is applied with a negative bias having a polarity opposite to that of the residual toner (or because the fur brush 41 is applied with a negative bias).

Just for information, it has been experimentally verified that, if the bar brush 53 is grounded, the charge amount of the residual toner is reduced from +5 μc/g to +0.5 μc/g.

In order to solve the above problem, the bar brush 53 is placed in an electrically floating state. Thus, residual toner on the transfer belt 125 reaching the bar brush 53 according to the circulating movement of the transfer belt 125 is brushingly wiped by the bristles 532 of the bar brush 53, and pulled apart from the outer surface of the transfer belt 125, without applying a bias having the opposite polarity or grounding. That is, the residual toner after passing through the bar brush 53 is simply mechanically peeled from the transfer belt 125 without any change in electrical characteristics. This allows the residual toner to be electrically attracted and removed by the fur brush 41 disposed in a vicinity of and on a downstream side relative to the bar brush 53 and applied with a bias having a polarity opposite to that thereof.

The bristles 532 may be made of a material suitable for allowing the residual toner to be positively charged during a sliding contact between the bristles 532 and the residual toner. In this case, even if residual toner reaching to the bristles 532 is positively charged in a relatively low charge amount, or negatively charged, the residual toner is positively charged by the sliding contact with the bristles 532, before reaching the negatively charged fur brush 41 of the main cleaning device 40. Thus, the residual toner will be reliably removed from the outer surface of the transfer belt 125.

The residual toner attached to the bristles of the fur brush 41 being rotated about the brush shaft 411 is moved to the outer peripheral surface of the collection roller 42 being rotated in such a manner that the outer peripheral surface is in contact with the bristles of the fur brush 41. The residual toner attached to the outer peripheral surface of the collection roller 42 is scraped off by the blade 43 according to the rotation of the collection roller 42, and collected into the collected-toner trapping space 310.

Particularly in this embodiment, the bristles 532 employed in the bar brush 53 is made of polyamide, as mentioned above. The polyamide bristles 532 are positively charged by a sliding contact with a given component (in this embodiment, the transfer belt 125). Thus, residual toner mechanically scraped off from the bristles 532 is readily separated or excluded from the bristles 532. This makes it possible to avoid an undesirable situation where the residual toner is held by the bar brush 53, and use the bar brush 53 for a long period of time without replacement, so as to provide enhanced maintenance efficiency.

As mentioned above in detail, the printer 10 according to this embodiment comprises a transfer belt 125 adapted to bear a toner image thereon, and a belt cleaning mechanism 30 disposed in opposed relation to an image bearing surface of the transfer belt 125 to clean and remove residual toner remaining on the image bearing surface. The belt cleaning mechanism 30 includes a main cleaning device 40, and an auxiliary cleaning device 50 provided in a vicinity of and on an upstream side relative to the main cleaning device 40. The auxiliary cleaning device 50 is adapted to be swingingly moved while following a displacement of the image bearing surface of the transfer belt 125 which is driven to move circulatingly.

The auxiliary cleaning device 50 is in contact with the image bearing surface over an entire width thereof in a direction of orthogonal to a moving direction of the transfer belt 125. Thus, according to this contact, the transfer belt 125 is subjected to a cleaning process over the entire width thereof.

The swing movement of the auxiliary cleaning device 50 allows a fluctuation in contact pressure applied to the transfer belt 125 to be maximally suppressed. This makes it possible to prevent the occurrence of an undesirable variation in cleaning effect on the image bearing surface (i.e., outer surface) of the transfer belt 125 so as to allow the outer surface of the transfer belt 125 to be reliably maintained in a condition where residual toner is uniformly removed and cleaned up.

Furthermore, the auxiliary cleaning device 50 presses the image bearing surface of the transfer belt 125 by its own weight. Thus, in response to a displacement of the transfer belt 125, the auxiliary cleaning device 50 can be swingingly moved up and down while following the displacement, and a pressing force against the transfer belt 125 is reliably maintained at a constant value, because the pressing force consists only of the weight of the auxiliary cleaning device 50 itself.

In addition, the auxiliary cleaning device 50 (specifically, a bar brush 53) is in an electrically floating state where it is not subjected to any electrical action. Thus, residual toner remaining on the transfer belt 125 is sent toward the main cleaning device 40 without any electrical change and in a readily-removable condition where the residual toner is pulled apart from the transfer belt 125 by a sliding contact with the auxiliary cleaning device 50, and then effectively removed by a bias in the main cleaning device 40.

While one embodiment of the present invention has been described as above, the present invention is not limited to the above embodiment. For example, the above embodiment may be modified as follows.

(1) While the above embodiment has been described by taking a printer 10 as one example of an image forming apparatus employing the intermediate transfer unit 20, the image forming apparatus of the present invention may be a copy machine or a facsimile machine.

(2) While the above embodiment has been described by taking a transfer belt 125 as one example of an image bearing member, the image bearing member applicable in the present invention may be a photosensitive drum.

(3) In the above embodiment, a transport mechanism, such as a spiral feeder, may be provided in the collected-toner trapping space 310 of the casing 31. In this case, according to driving of the transport mechanism, collected toner accumulated in the collected-toner trapping space 310 may be transported to a given waste-toner hopper.

Figure 8:
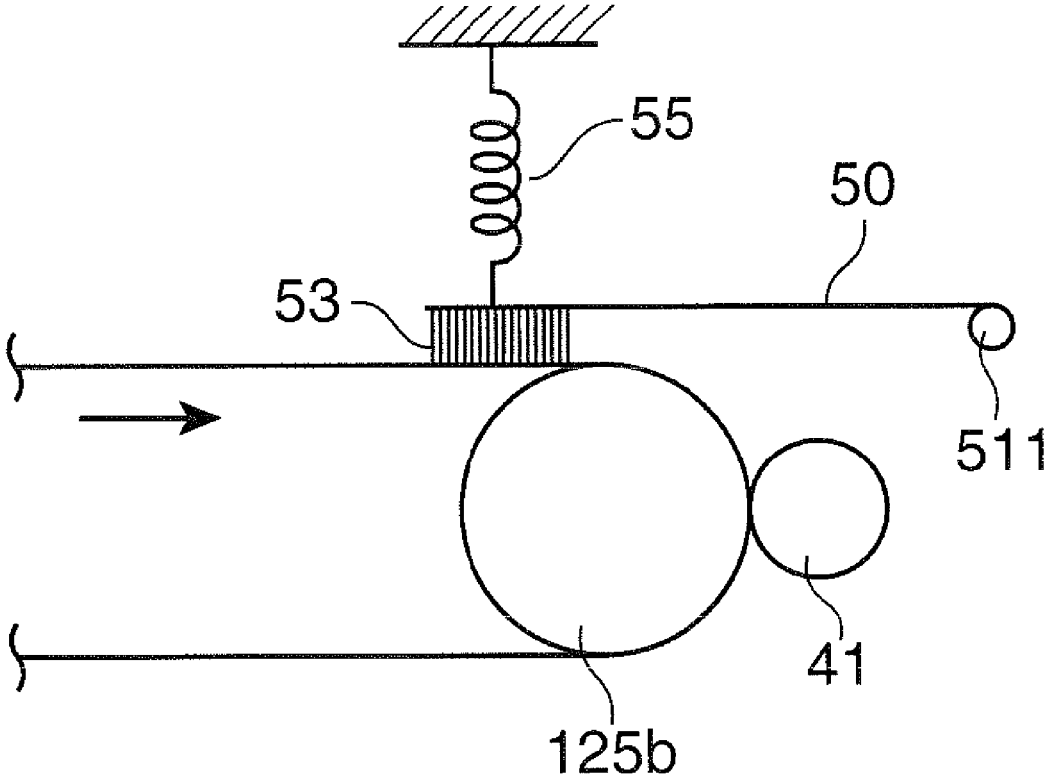
FIG. 8 is a schematic diagram showing one example of modification of the intermediate transfer unit.

(4) The above embodiment has been described based on one example where the auxiliary cleaning device 50 is brought into press contact with the transfer belt 125 by its own weight. Alternatively, as shown in FIG. 8, the auxiliary cleaning device 50 may be pressed against the image bearing surface of the transfer belt 125 by an urging force of an urging member 55, such as a coil spring. In this case, for example, even if the transfer belt 50 is arranged to circulatingly move in a vertical (or non-horizontal) direction, and thereby the weight of the auxiliary cleaning device 50 itself cannot be utilized to allow the auxiliary cleaning device 50 to be brought into press contact with the transfer belt 125, the auxiliary cleaning device 50 can be brought into press contact with the transfer belt 125 by the urging force of the urging member 55. This makes it possible to provide enhanced flexibility in installation layout of the auxiliary cleaning device 50.

The above specific embodiment primarily includes an invention having the following features.

An image forming apparatus according to one aspect of the present invention comprises: an image bearing member having an image bearing surface adapted to move in a given direction and bear a toner image thereon; a main cleaning device disposed in opposed relation to the image bearing surface to electrically remove residual toner remaining on the image bearing surface; a power supply adapted to apply to the main cleaning device a bias having a polarity reverse to a charge polarity of the residual toner; an auxiliary cleaning device provided in a vicinity of and on an upstream side relative to the main cleaning device with respect to the moving direction of the image bearing surface, and adapted to be brought into contact with the image bearing surface; and a support structure which supports the auxiliary cleaning device in such a manner as to permit the auxiliary cleaning device to be swingingly moved while following a displacement of the image bearing surface during the moving.

In the image forming apparatus of the present invention, the swing movement of the auxiliary cleaning device allows a fluctuation in contact pressure applied to the image bearing surface to be maximally suppressed. This makes it possible to prevent the occurrence of an undesirable variation in cleaning effect on the image bearing surface so as to allow the image bearing surface to be reliably maintained in a condition where residual toner is uniformly removed and cleaned up.

Preferably, in the image forming apparatus of the present invention, the auxiliary cleaning device has a size capable of being in contact with the image bearing surface over an entire width thereof in a direction orthogonal to the moving direction of the image bearing surface.

According to this feature, the image bearing member can be subjected to a preliminary cleaning process, over the entire width thereof, by the auxiliary cleaning device, in advance of a primary cleaning process by the main cleaning device.

Preferably, in the image forming apparatus of the present invention, the auxiliary cleaning device is adapted to press the image bearing surface of the image bearing member by its own weight, while being in contact with an upwardly facing region of the image bearing surface. According to this feature, in response to a displacement of the image bearing surface, the auxiliary cleaning device can be swingingly moved up and down while following the displacement, and a pressing force against the image bearing member is reliably maintained at a constant value, because the pressing force consists only of the weight of the auxiliary cleaning device itself.

Preferably, in this image forming apparatus, the auxiliary cleaning device includes a frame member, and a cleaner attached relative to one of opposite ends of the frame member, and the support structure pivotally supports the other end of the frame member in a rotatable manner. According to this feature, the support structure can be desirably simplified.

Preferably, in the image forming apparatus of the present invention, the auxiliary cleaning device is in an electrically floating state where it is isolated from an electrical system of the image forming apparatus including a grounding system. According to this feature, residual toner remaining on the image bearing member is sent toward the main cleaning device without any electrical change even after contact with the auxiliary cleaning device, and in a readily-removable condition where the residual toner is pulled apart from the image bearing member by a sliding contact with the auxiliary cleaning device. This makes it possible to allow the residual toner to be readily removed by the bias in the main cleaning device.

Preferably, in this image forming apparatus, the auxiliary cleaning device includes a brush adapted to brushingly wipe the image bearing surface. According to this feature, residual toner attached on the image bearing surface of the image bearing member is blushingly wiped by the brush and effectively pulled apart from the image bearing surface.

Preferably, in this image forming apparatus, the brush comprises bristles made of a material which is adapted to be charged to a polarity identical to a charge polarity of a toner to be borne on the image bearing surface. According to this feature, even when the brush is electrostatically charged due to a slide contact between the brush and the image bearing member, the static charge has a polarity identical to that of the residual toner, and therefore the residual toner never moves from the image bearing member to the brush. This makes it possible to prevent deterioration in cleaning performance due to residual toner accumulated in the brush.

Preferably, in the image forming apparatus of the present invention, the auxiliary cleaning device includes a frame member, a clearer attached relative to the frame member, and an electrical insulating member interposed between the frame member and the cleaner. According to this feature, the cleaner can be placed in an electrically floating state.

Preferably, in this image forming apparatus, the cleaner is a bar brush, and the electrical insulating member is a two-sided adhesive tape. This makes it possible to simplify an electrical insulating structure for the cleaner (bar brush).

Preferably, in the above image forming apparatus, the auxiliary cleaning device includes a frame member, a bar brush attached relative to one of opposite ends of the frame member, and an electrical insulating member interposed between the frame member and the bar brush; and the support structure pivotally supports the other end of the frame member in a swingable manner. According to this feature, an electrically floating structure for the auxiliary cleaning device, and a support structure for allowing the auxiliary cleaning device to be swingingly moved while following a displacement of the image bearing surface, can be structurally simplified.

In this image forming apparatus, the frame member may include a brush holder formed to mount thereto the bar brush, and a frame formed to mount thereto the brush holder and have a pivot member. According to this feature, a member for mounting thereto the bar brush, and a pivot member, are formed as separated components. This makes it possible to facilitate a component replacement operation and a maintenance operation.

In a preferred embodiment of the present invention, the image bearing member is a transfer belt. The transfer belt is likely to vibrate in a direction orthogonal to the moving direction due to a rapid change in mode of force applied thereto, for example, during starting and stopping of driving. In this case, the auxiliary cleaning device in contact with the transfer belt in a swingingly movable manner can follow the vibration of the transfer belt without largely changing a contact force against the image bearing surface. This is effective in reliably subjecting the image bearing surface of the transfer belt to an adequate cleaning process.

Preferably, the above image forming apparatus further comprises: a first roller adapted to be rotated; a second roller disposed in horizontally spaced-apart relation to the first roller, and adapted to be rotated; and a transfer roller disposed in opposed relation to the second roller, wherein: the image bearing member is a transfer belt which is wound around at least between the first and second rollers in such a manner that the moving direction of the image bearing surface is reversed at respective positions of the first and second rollers, whereby the image bearing surface has an upwardly facing region and a downwardly facing region; the main cleaning device being disposed in opposed relation to the first roller; and the auxiliary cleaning device being adapted to be brought into contact with the upwardly facing region of the image bearing surface in a vicinity of the first roller.

Preferably, the image forming apparatus of the present invention further comprises an urging member urging the auxiliary cleaning device toward the image bearing surface. According to this feature, the auxiliary cleaning device is pressed against the image bearing surface by an urging force of the urging member. This makes it possible to reliably bring the auxiliary cleaning member into contact with the image bearing surface at a constant pressure even if the image bearing surface is arranged in a non-horizontal direction.

An image forming apparatus according to another aspect of the present invention comprises: an image bearing member having an image bearing surface adapted to move in a given direction and bear a toner image thereon; a main cleaning device disposed in opposed relation to the image bearing surface to electrically remove residual toner remaining on the image bearing surface; a power supply adapted to apply to the main cleaning device a bias having a polarity reverse to a charge polarity of the residual toner; and an auxiliary cleaning device provided in a vicinity of and on an upstream side relative to the main cleaning device with respect to the moving direction of the image bearing surface, and adapted to be brought into contact with the image bearing surface, wherein the auxiliary cleaning device is in an electrically floating state where it is isolated from an electrical system of the image forming apparatus including a grounding system.

In the image forming apparatus of the present invention, residual toner remaining on the image bearing member is sent toward the main cleaning device without any electrical change even after contact with the auxiliary cleaning device, and in a readily-removable condition where the residual toner is pulled apart from the image bearing member by a sliding contact with the auxiliary cleaning device. This makes it possible to allow the residual toner to be readily removed by the bias in the main cleaning device.

This application is based on Japanese Patent application Ser. Nos. 2007-137142 and 2007-137143 filed in Japan Patent Office on May 23, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a unit frame;

a plurality of rollers mounted on said unit frame;

an image bearing member having an image bearing surface wound around said plurality of rollers and adapted to move in a given moving direction and bear a toner image thereon;

a main cleaning device disposed in opposed relation to said image bearing surface to electrically remove residual toner remaining on said image bearing surface;

a casing fixed to said unit frame and housing said main cleaning device;

a power supply adapted to apply to said main cleaning device a bias having a polarity reverse to a charge polarity of said residual toner;

an auxiliary cleaning device provided in a vicinity of and on an upstream side relative to said main cleaning device with respect to said moving direction of said image bearing surface, said auxiliary cleaning device having a frame member with opposite first and second ends, a cleaner attached to the first end of the frame member and adapted to be brought into contact with said image bearing surface; and a support structure which pivotally supports said second end of the frame member of said auxiliary cleaning device in rotatable a manner relative to the casing to permit the cleaner attached to the first end of the frame member of said auxiliary cleaning device to be swingingly moved simultaneously with the moving of the image bearing surface while following a displacement of said image bearing surface during the moving.

2. The image forming apparatus as defined in claim 1, wherein said auxiliary cleaning device has a size capable of being in contact with said image bearing surface over an entire width thereof in a direction orthogonal to said moving direction of said image bearing surface.

3. The image forming apparatus as defined in claim 1, wherein said auxiliary cleaning device is adapted to press said image bearing surface of said image bearing member by its own weight, while being in contact with an upwardly facing region of said image bearing surface.

4. The image forming apparatus as defined in claim 3, wherein said plurality of rollers include: a first roller adapted to be rotated; a second roller disposed in horizontally spaced-apart relation to said first roller, and adapted to be rotated; and a transfer roller disposed in opposed relation to said second roller, and wherein:

said image bearing member is a transfer belt which is wound around at least between said first and second rollers in such a manner that said moving direction of said image bearing surface is reversed at respective positions of said first and second rollers, whereby said image bearing surface has an upwardly facing region and a downwardly facing region;

said main cleaning device is disposed in opposed relation to said first roller; and said auxiliary cleaning device is adapted to be brought into contact with said upwardly facing region of said image bearing surface in a vicinity of said first roller.

5. The image forming apparatus as defined in claim 1, wherein said auxiliary cleaning device is in an electrically floating state where it is isolated from an electrical system of said image forming apparatus including a grounding system.

6. The image forming apparatus as defined in claim 5, wherein cleaner is a brush adapted to brushingly wipe said image bearing surface.

7. The image forming apparatus as defined in claim 6, wherein said brush comprises bristles made of a material which is adapted to be charged to a polarity identical to a charge polarity of a toner to be borne on said image bearing surface.

8. The image forming apparatus as defined in claim 6, wherein said frame member includes:

a brush holder formed to mount said brush thereto and a frame formed to mount said brush holder thereto, said frame having a pivot member at the second end of the frame member, the support structure pivotally supporting the second end of the frame member at the pivot member.

9. The image forming apparatus as defined in claim 1, wherein said auxiliary cleaning device includes an electrical insulating member interposed between said frame member and said cleaner.

10. The image forming apparatus as defined in claim 9, wherein:

said cleaner is a bar brush; and said electrical insulating member is a two-sided adhesive tape.

11. The image forming apparatus as defined in claim 1, wherein said image bearing member is a transfer belt.

12. The image forming apparatus as defined in claim 1, which further comprises an urging member urging said auxiliary cleaning device toward said image bearing surface.

13. The image forming apparatus as defined in claim 1, wherein at least part of the cleaner contacts an area of the image bearing member that is unsupported between two of the rollers.

14. The image forming apparatus as defined in claim 1, wherein one of the rollers is a tension roller, at least part of the cleaner contacting a section of the image bearing member between the tension roller and another of the plurality of rollers.

15. An image forming apparatus comprising:

a unit frame;

a plurality of rollers mounted on said unit frame;

an image bearing member having an image bearing surface wound around said plurality of rollers and adapted to move in a given moving direction and bear a toner image thereon;

a main cleaning device disposed in opposed relation to said image bearing surface to electrically remove residual toner remaining on said image bearing surface;

a casing fixed to said unit frame and housing said main cleaning device;

a power supply adapted to apply to said main cleaning device a bias having a polarity reverse to a charge polarity of said residual toner;

an auxiliary cleaning device provided in a vicinity of and on an upstream side relative to said main cleaning device with respect to said moving direction of said image bearing surface, said auxiliary cleaning device having a frame member with opposite first and second ends, a cleaner attached to the first end of the frame member and adapted to be brought into contact with said image bearing surface, said auxiliary cleaning device being in an electrically floating state where it is isolated from an electrical system of said image forming apparatus including a grounding system; and a support structure pivotally supporting the second end of the frame member in a rotatable manner relative to said casing to permit the cleaner attached to the first end of the frame member of said auxiliary cleaning device to be moved swingingly simultaneously with the moving of the image bearing surface while following a displacement of the image bearing surface.

16. An image forming apparatus comprising:

an image bearing member having an image bearing surface adapted to move in a given direction and bear a toner image thereon;

a main cleaning device disposed in opposed relation to said image bearing surface to electrically remove residual toner remaining on said image bearing surface;

a power supply adapted to apply to said main cleaning device a bias having a polarity reverse to a charge polarity of said residual toner;

an auxiliary cleaning device provided in a vicinity of and on an upstream side relative to said main cleaning device with respect to said moving direction of said image bearing surface, and adapted to be brought into contact with said image bearing surface; and a support structure which supports said auxiliary cleaning device in such a manner as to permit said auxiliary cleaning device to be swingingly moved simultaneously with the moving of the image bearing surface while following a displacement of said image bearing surface during the moving, wherein said auxiliary cleaning device includes a frame member, a cleaner attached relative to said frame member, and an electrical insulating member interposed between said frame member and said cleaner.

17. The image forming apparatus as defined in claim 16, wherein:

said cleaner is a bar brush; and said electrical insulating member is a two-sided adhesive tape.

18. The image forming apparatus as defined in claim 16, wherein said auxiliary cleaning device is adapted to press said image bearing surface of said image bearing member by its own weight, while being in contact with an upwardly facing region of said image bearing surface;

said auxiliary cleaning device includes a frame member, a bar brush attached relative to one of opposite ends of said frame member, and an electrical insulating member interposed between said frame member and said bar brush; and said support structure is a structure adapted to pivotally support the other end of said frame member in a rotatable manner.

* * * * *